United States Patent [19]

Paro

[11] 4,364,307

[45] Dec. 21, 1982

[54] LUBRICATION SYSTEM

[75] Inventor: Daniel Paro, Kvevlax, Finland

[73] Assignee: Oy Wartsila AB, Helsinki, Finland

[21] Appl. No.: 121,286

[22] Filed: Feb. 13, 1980

[30] Foreign Application Priority Data

Feb. 16, 1979 [FI] Finland ..... 790511

[51] Int. Cl.[3] ..... F01B 31/10

[52] U.S. Cl. ..... 92/157; 92/160; 123/41.38

[58] Field of Search ..... 92/160, 157, 158, 159; 123/41.38, 41.39

[56] References Cited

U.S. PATENT DOCUMENTS

| | | | |
|---|---|---|---|
| 1,304,615 | 5/1919 | Smith, Jr. | 92/159 |
| 2,200,015 | 5/1940 | Alexandrescu | 92/160 |
| 2,843,221 | 7/1958 | Horing | 92/159 |
| 2,889,182 | 6/1959 | Marshall | 92/157 |
| 3,168,013 | 2/1965 | Williamson | 92/160 |

*Primary Examiner*—Paul E. Maslousky

*Attorney, Agent, or Firm*—McAulay, Fields, Fisher, Goldstein & Nissen

[57] ABSTRACT

A cylinder lubrication system for a combustion engine. The lubricant is directed to the cylinder wall through a piston moving in the cylinder. The piston comprises a piston pin above which there are a plurality of piston rings sealing a combustion chamber at the top side of the piston. There is a lubrication groove in the outer mantle surface of the piston between the piston pin and at least a majority of the piston rings, preferably all of the piston rings. The lubrication groove is open in a direction outwardly from the piston and has lubricant feed ducts connected thereto from the inside of the piston. In the feed ducts the lubricant is subject to continuous pressure when the engine is continuously running.

7 Claims, 2 Drawing Figures

LUBRICATION SYSTEM

Figure 1:
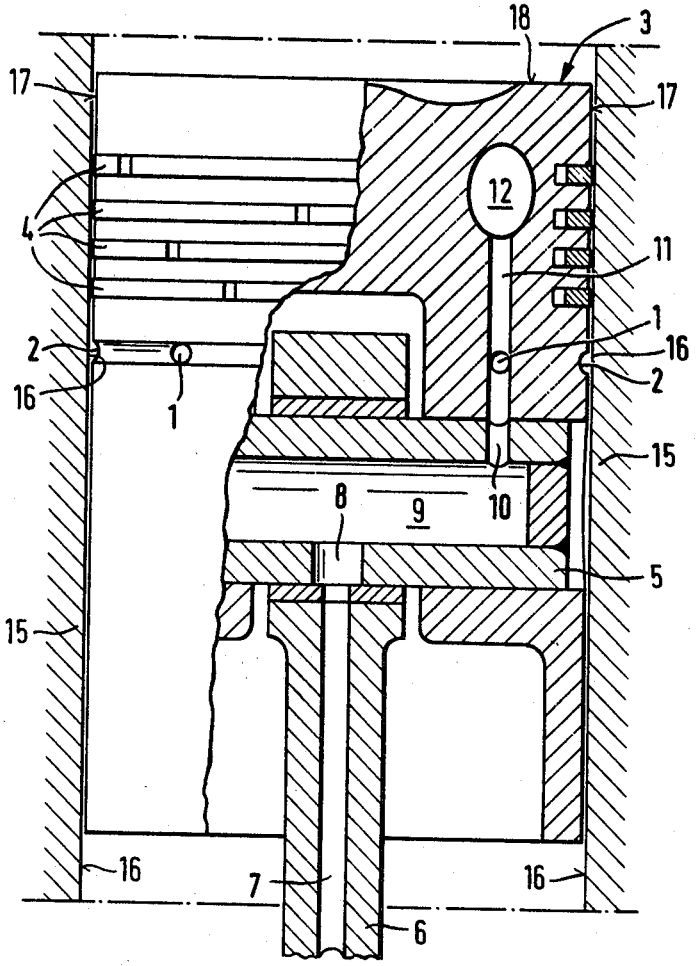

The invention relates to a cylinder lubrication system for a combustion engine, in which lubricant is directed to the cylinder wall through a piston moving in said cylinder, which piston comprises a piston pin above which there are a plurality of piston rings sealing a combustion chamber at the top side of said piston.

The lubrication of the cylinders in combustion engines, primarily in diesel engines, is arranged either as so called splash lubrication caused by moving parts of the engine or by means of devices feeding lubricant through borings in the cylinder wall. The lubricant circulation in splash lubrication is rather slow, and hence, the efficiency of the lubrication is poor. On the other hand, when lubrication is carried out through the cylinder walls, a portion of the lubricant will get into the combustion chamber of the cylinder unless a precise lubricant feeding device is used. Further, the feeding apertures, with possible oil grooves, made in the cylinder liner, are unfavourable with regard to the piston rings causing extra wear in them.

It has also been suggested, for instance, in German Pat. No. 725714 and U.S. Pat. No. 2,386,117 to supply oil under pressure through the piston of the cylinder to be lubricated and to feed the oil to the cylinder wall through the piston ring grooves of the piston. However, this is not a good solution, because the piston ring and its movements in the groove will disturb the even flow of the oil most severly, and further, the piston ring groove has to be designed to meet the requirements of the piston ring and cannot be designed to efficiently meet the lubrication requirements. In particular, when oil is fed through the uppermost piston ring, a great portion of the oil will reach the combustion chamber at the top side of the piston, which is a waste of oil and is harmful to the engine. It has also been suggested, in British Pat. No. 1,167,008, to feed oil to the cylinder by means of a lubrication groove in the piston, to which oil is led by means of gravity. This solution has also proved to be inefficient, because, due to the reciprocating movement of the piston, gravity feeding of oil to a lubrication groove will not give an acceptable result. In U.S. Pat. No. 1,910,902 it has been suggested to feed oil under pressure to an annual duct below the piston pin, which duct is covered by a sleeve provided with a number of small apertures. However, the feeding of oil through small apertures and below the piston pin has proved to be an ineffective way of providing proper lubrication to the cylinder wall.

The object of the invention is to improve the lubrication of the cylinder and of the piston mantle of a combustion engine in such a way, that it is superior to known solutions also when applied to new, more efficient engines. The object is as well to eliminate other disadvantages present in known solutions.

The characteristics of the invention are evident from claim 1. By means of a lubrication system according to the invention a fast and steady lubricant circulation is guaranteed. In addition, the solution is also constructionally favourable and easy to apply, since it does not require changes in the basic construction of the cylinder or the cylinder liner.

The lubrication groove should preferably extend all round the piston, but in some cases it is sufficient to have a groove extending only over a sector of about 120° in the middle region of the two side halves of the piston. The side halves are determined by an axial plane of the piston through the central axis of the piston pin.

It is not recommended to arrange the lubrication groove between the piston rings, even if in some cases this could be an acceptable solution. The result is very much dependent on the construction of the piston rings adjacent to the lubrication groove. If, in particular, the piston ring or rings below the lubrication groove are formed so that they give a good oil distributing effect and are not in the first place designed to work as sealing elements like ordinary piston rings, then a piston ring below the lubrication groove could in some cases be used.

In the feeding of lubricant, the oil ducts being part of a cooling system of the piston head can with advantage be used. The feeding apertures should thereby be connected specifically to the inlet duct of the cooling system, where the oil temperature is lower.

For properly regulating the feeding of lubricant the feeding apertures can be provided with an interchangeable throttle plug. The throttle plug should be chosen to suit, for instance, the oil used and other working characteristics of the engine. It can be changed, if the cylinder receives too much or too little oil.

Figure 2:
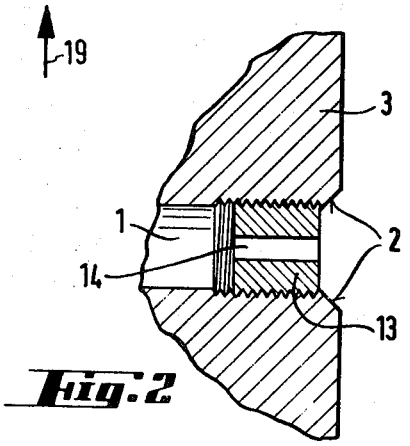

In the following, the invention is described more in detail, with reference to the attached drawing, in which FIG. 1 shows, partly in section, a favourable embodiment of a lubrication system according to the invention, FIG. 2 shows a throttle plug in the lubricant feeding aperture of the piston of a lubrication system according to FIG. 1.

In the piston 3 shown in the drawing, there are lubricant feeding apertures 1, which are interconnected by means of a lubrication groove 2.

Piston 3 moves within cylinder 15 and lubricant is directed to the cylinder wall 16. The lubricant is led to feeding apertures 1 through a duct 7 in the connecting rod 6, through ducts 8, 9 and 10 in the piston pin 5 and through ducts 11 in the piston. Said ducts operate also as feed ducts for the piston head cooling system, through which oil is directed in a way known per se to a collecting cavity 12 in the piston head. The cylinder lubrication is thus constructionally rather conveniently obtainable.

Piston 3 has an outer mantle surface 17 and a top surface 18 at one end of the mantle surface.

Lubrication groove 2 is located between piston rings 4 and piston pin 5. Oil is fed to the lubrication groove under continuous pressure as long as the engine runs.

Arrow 19 at the lower end of duct 7 schematically indicates and symbolizes the feeding of oil under pressure into duct 7 so that the oil in duct 7 is continuously under pressure when piston 3 is operative.

For regulating the lubricant feeding properly, apertures 1 can be provided with a throttle plug 13, in which there is a throttled opening 14. Thus, the feeding apertures can easily be restricted to a proper size. If a more intense lubrication is needed, plugs 13 can be changed to other plugs having a larger opening 14.

The invention is not limited to the embodiment shown, but several modifications thereof are feasible within the scope of the attached claims.

I claim:

1. A cylinder lubrication system for a combustion engine having a combustion chamber, in which lubricating oil is directed to a cylinder wall of a cylinder through a piston moving in said cylinder, said piston comprising an outer mantle surface, a top surface at one end of said mantle surface, a piston pin below said top surface and, sealing said combustion chamber, a plurality of piston rings in said mantle surface between said top surface and said piston pin;

said lubrication system including:

a lubrication groove in said outer mantle surface of said piston between said piston pin and at least a majority of said piston rings, said lubrication groove being open in a direction outwardly from said piston; and a feed system for feeding an accurately controllable amount of lubricating oil to said lubrication groove; said feed system including:

lubricant feed ducts in said piston;

means for continuously supplying the lubricating oil under pressure to said feed ducts;

said feed ducts providing continuous pressurized feeding of said lubricating oil to said lubrication groove in a direction from the interior of said piston outwardly to said groove; and regulating means for providing an accurately controllable continuous flow of lubricating oil to said groove.

2. A system according to claim 1, in which said lubrication groove is between said piston pin and all of said piston rings.

3. A system according to claim 1 or 2, in which said lubrication groove extends over a sector of about 120° in the middle region of two side halves of said piston, said halves being determined by a axial plane of said piston through the central axis of said piston pin.

4. A system according to claim 1 or 2, in which said lubrication groove extends all around said piston.

5. A system according to claim 1, in which the regulating means includes interchangeable throttle elements in said lubricant feed ducts.

6. A system according to claim 5, in which the throttle elements are at an outlet end of said lubricant feed ducts.

7. A system according to claim 1, in which the piston includes a cooling system between said top surface and said piston pin, said feed ducts being connected to an inlet of said cooling system.

* * * * *